US008047968B2

(12) United States Patent
Stewart et al.

(10) Patent No.: US 8,047,968 B2
(45) Date of Patent: Nov. 1, 2011

(54) SIMULATED CLIMBING AND FULL BODY EXERCISE AND METHOD

(76) Inventors: Brian Charles Stewart, Oregon City, OR (US); Michael Shane Lofgren, Tualatin, OR (US)

( * ) Notice: Subject to any disclaimer, the term of this patent is extended or adjusted under 35 U.S.C. 154(b) by 82 days.

(21) Appl. No.: 12/578,771

(22) Filed: Oct. 14, 2009

(65) Prior Publication Data

US 2011/0086743 A1 Apr. 14, 2011

(51) Int. Cl.
*A63B 22/04* (2006.01)
*A63B 21/068* (2006.01)

(52) U.S. Cl. ..... 482/51; 482/52; 482/95

(58) Field of Classification Search ..... 482/51–53, 482/57, 54, 38, 69, 95–97; 601/5, 23, 35
See application file for complete search history.

(56) References Cited

U.S. PATENT DOCUMENTS 2,144,206 A * 1/1939 Thompson ..... 472/17
2,630,332 A * 3/1953 Pettijohn ..... 280/233
3,662,747 A * 5/1972 Williams ..... 601/5
3,744,794 A * 7/1973 Gause et al. ..... 482/57
3,750,479 A * 8/1973 Gause et al. ..... 73/379.07
4,043,552 A * 8/1977 Kerkonian ..... 482/96
4,176,836 A * 12/1979 Coyle ..... 482/96
4,285,515 A * 8/1981 Gezari ..... 482/57
4,372,551 A * 2/1983 Yurdin ..... 482/57
4,512,567 A * 4/1985 Phillips ..... 463/37
4,700,946 A * 10/1987 Breunig ..... 482/57
4,717,148 A * 1/1988 Brewer ..... 482/144
4,881,732 A * 11/1989 Kepiro ..... 482/62
4,986,261 A * 1/1991 Iams et al. ..... 601/35
5,145,472 A * 9/1992 Johnson et al. ..... 482/37
5,277,680 A * 1/1994 Johnston ..... 482/95
5,449,334 A * 9/1995 Kingsbury ..... 482/57
5,453,066 A * 9/1995 Richter, Jr. ..... 482/96
5,499,959 A * 3/1996 Holmes et al. ..... 482/95
5,507,710 A * 4/1996 Chen ..... 482/72
5,632,707 A * 5/1997 Daniel et al. ..... 482/8
5,762,588 A * 6/1998 Chen ..... 482/57
5,779,598 A * 7/1998 Lee ..... 482/57
5,857,943 A * 1/1999 Murray ..... 482/57
5,941,800 A * 8/1999 Laconis ..... 482/70
5,967,944 A * 10/1999 Vittone et al. ..... 482/52
6,228,004 B1 * 5/2001 Steinbach et al. ..... 482/121
6,244,995 B1 * 6/2001 Prsala ..... 482/96
6,261,250 B1 * 7/2001 Phillips ..... 601/23
6,338,700 B1 * 1/2002 Pollock ..... 482/95
6,361,476 B1 * 3/2002 Eschenbach ..... 482/52
6,443,876 B1 * 9/2002 Huang ..... 482/54
6,554,747 B1 * 4/2003 Rempe ..... 482/38
6,592,502 B1 * 7/2003 Phillips ..... 482/143
6,827,672 B2 * 12/2004 Miceli ..... 482/69
7,316,633 B2 * 1/2008 Liao et al. ..... 482/52
7,357,757 B2 * 4/2008 Brown ..... 482/37
7,494,450 B2 * 2/2009 Solomon ..... 482/69
7,513,853 B1 * 4/2009 Russ ..... 482/51

(Continued)

*Primary Examiner* — Stephen Crow

(57) ABSTRACT

An apparatus and method permitting a user to perform a simulated climbing and full body exercise is provided. The design includes a frame and a pair of lever arms and a pair of foot platforms and a torso support. The frame is configured to place the operator's center of gravity in a position of falling away from the frame, lever arms, foot platforms and providing a torso support enabling the operator to be supported by hanging from the hands and supported by the feet and torso support. The frame may be rotated through varying angles from vertical permitting the operator's center of gravity to fall away from the frame and allow the operator to hang away from the frame further enhancing the climbing experience.

4 Claims, 11 Drawing Sheets

U.S. PATENT DOCUMENTS

| | | | | |
|---|---|---|---|---|
| 7,594,877 | B2 * | 9/2009 | Anderson et al. | 482/52 |
| 7,618,350 | B2 * | 11/2009 | Dalebout et al. | 482/52 |
| 7,722,508 | B2 * | 5/2010 | Hetrick | 482/95 |
| 7,837,595 | B2 * | 11/2010 | Rice | 482/4 |
| 7,878,959 | B2 * | 2/2011 | Chen et al. | 482/142 |
| 2006/0128537 | A1 * | 6/2006 | Philips | 482/95 |
| 2006/0247104 | A1 * | 11/2006 | Grabiner et al. | 482/54 |
| 2006/0281604 | A1 * | 12/2006 | Stewart et al. | 482/51 |
| 2008/0039290 | A1 * | 2/2008 | Manguso | 482/78 |
| 2008/0293545 | A1 * | 11/2008 | Planke | 482/7 |
| 2011/0028281 | A1 * | 2/2011 | Ish et al. | 482/95 |

* cited by examiner

SIMULATED CLIMBING AND FULL BODY EXERCISE AND METHOD

BACKGROUND OF THE INVENTION

1. Field of the Invention

The present invention relates generally to the field of exercise equipment, and more specifically to exercise apparatus for aerobic and anaerobic strength training that permits a user to perform a simulated climbing and full body exercise.

2. Description of the Related Art

Cardio-pulmonary, cardiovascular, and strength training exercise equipment found in today's exercise and health centers as well as in the home seek to improve and maintain an individual's aerobic and strength fitness. Many types of exercise equipment, including treadmills, rowing machines, stationary bicycles, stair-stepping machines, and dry-land swimming machines are available for individuals who desire to maintain and improve their overall fitness and conditioning.

Elliptical exercise machines with and without arm engagement provide users a means of engaging the legs and arms in an aerobic exercise involving the leg muscles and arm muscles and balance and attempt to recreate the action of running without the accompanying impact of actual running and generally against a resistance created either by a friction pad against a flywheel or magnetic resistance. Tread mills provide users with an aerobic exercise involving the leg muscles only and attempt to recreate running in place against a moveable conveyor belt type tread sometimes against friction or sometimes the treadmill is slightly inclined to simulate climbing a hill. Various lat pull machines and leg press machines provide the user with an anaerobic exercise in which the user exerts his or her muscles against a resistance generally determined by the stacking of weights. These types of anaerobic exercises are done generally in sets and last typically a few seconds and engaged by exerting the muscles of one part of the body against a movable weight. Rope climbing machines exist and provide the user with a simulated rope climbing exercise which is generally involved with the arms and is a combination of aerobic and anaerobic exercise in which the user is basically stationary and the rope is pulled past the user and the difficulty of the pulling the rope is controlled by some type of friction device that the rope pulls through. Climbing machines provide the user with many ways to climb simulated ladders, rock walls and other combined leg and arm exercise where the user is stationary and the ladder rungs, rock wall, etc. are pulled past the user by the user's legs and feet and arms and hands while the user stays in the same place. In all of these machines the user is sitting upon, standing on, walking or running on or supported by the machine or equipment in a vertical position that eliminates the effect of gravity on the user's body in the sense that the user is not resisting the pull of gravity to maintain his or her body position.

The present full body exercise apparatus offers the user the opportunity to exercise in a manner that can be as extreme as attempting to climb under an overhanging rock outcropping while on belay. Or, can be as gentle as a typical elliptical machine or treadmill. The present full body exercise apparatus provides the user with the opportunity to engage in a combined aerobic and anaerobic exercise that can not be maintained for longer than a few minutes depending on the condition of the user and the adjustment of the machine but over time will allow the user to gradually increase the length of time before maximum exertion is reached but ultimately maximum exertion will be reached providing a tremendous and compelling challenge to the user.

Other machines provide the user with the opportunity to max out his physical ability but this is accomplished by increasing the weight that the user is elevating or by increasing the friction against the device that is resisting the user's efforts. The present upper body exercise apparatus accomplishes the ability to require maximum effort from the user by positioning the user's body relative to the machine in a position that is angled away from the machine. This causes gravity to be exerted on the body in such a way that no weight other than the user's body is needed to increase effort. Depending on the angle of the machine maximum effort is only sustainable for a finite amount of time while exercising. The present machine provides the user with the opportunity to aerobically press with their legs and feet while hanging from their arms and engaging in a running type motion while hanging cantilevered in space relative to the machine. The present invention provides the user with a device to work against the effects of gravity. When the user operates the present device engaging the machine only by the hands and feet the user depending on level of fitness can expect to reach maximum exertion in less than five minutes when the machine is at its extreme setting.

The same user in the same physical condition can expect to use the machine for a much greater time when the following second aspect of the full body exercise apparatus is engaged by the user. While the user is suspended in space and while his hands and feet engage the handles and foot platforms a secondary device is provided to engage and support the operator's back or buttocks in a manner that partially offsets the pull of gravity on the user's arms making the exercise apparatus much easier to use and spreads the required work load across a larger portion of the body through the abdominals and midsection providing an incredible exercise. The combination of the back support and the angle of the apparatus that establishes the amount of cantilever of the user and the amount of the effect of gravity on the user determine the level of exertion necessary to operate the exercise apparatus. Although angle alone and use of or lack of use of the back support is sufficient to determine the level of exertion, the full body exercise apparatus also includes the opportunity to provide frictional or magnetic resistance against the moving arm levers and feet platforms to give even greater control of the exercise experience.

Lat pull machines provide the opportunity to exercise the arm and upper body muscles groups and leg press machines provide the opportunity to exercise the legs and lower body muscle groups but in an essentially anaerobic manner. The user is unable to rhythmically move the machines in a steady sustained manner for any length of time and thus the exercise is completed in numerous sets of activity. Elliptical machines, treadmills, rope climbing machines, rock climbing machines provide some opportunity to engage in aerobic exercise but do not suspend the user's body nor support the user's body against the pull of gravity in such a manner that the user can use his or her own weight to determine the level of exercise up to the point of maximum exertion. It is desirable in these high paced modern times to be able to exercise quickly and with the greatest involvement and the use of the most muscle groups of the body for the shortest time but still to the point of maximum benefit. Existing elliptical machines and treadmills require long periods of time, even against maximum resistance settings, to elevate a well conditioned athlete to maximum exertion and heart rate. Rope climbing machines and wall climbing machines, even with maximum resistance, can not quickly force the user to maximum effort because the user will simply climb the wall or the rope when the effort exerted is greater than the pull of gravity. In the present full body exercise apparatus the user will reach maximum exertion to the point of cessation in as little as one or two minutes if the angle determining the amount of suspension of the user and the resistance are set to maximum.

It would therefore be beneficial to provide a full body exercise apparatus that provides the maximum amount of conditioning in the shortest time using the greatest amount of muscle groups. This creates the most complete combination of aerobic and anaerobic exercise that the user desires and overcomes the limitations found in the current elliptical machines, treadmills, rope climbing machines, stair stepping machines and moveable rock climbing walls.

SUMMARY OF THE INVENTION

According to one aspect of the present design, there is provided an apparatus permitting a user to perform a simulated full body climbing exercise. The design includes a frame with hand levers for engaging the user's hands and feet support platforms for engaging the user's feet. The hand levers are at the end of levers configured to attach to the frame and further configured to pivot about an axis perpendicular to their length and further configured to engage the feet support platforms such that movement of the hand levers provides for movement of the engaged foot support platform. Each foot support platform is in turn engaged with a wheel or bell crank or linkage arrangement configured to provide interaction between each foot support platform such that the movement of one foot support platform engages the other foot support platform through the wheel, bell crank or linkage such that movement of one foot platform provides a corresponding movement in the other foot platform. Each foot support platform is of sufficient length to allow the user to position their feet in a number of positions along the length of the foot support platform. The user may place his feet toward the forward end of the foot support platform and lean back away from the apparatus or may move his feet rearward on the foot support platform to stand more vertically. By moving the feet either forward or back on the foot platforms the user is able to engage different muscles groups of the legs. The device is configured to engage the user's hands and feet with the user's body in one position by standing over the foot support platforms, grasping the hand levers and walking. In this position the user's center of gravity is essentially directly above the center of the path defined by the movement of the foot support platforms. The device is also configured to permit rotation of the exercise apparatus in a manner that provides for the user's center of gravity to move away from directly above the center of the path defined by the foot support platforms towards the rear of the path defined by the foot support platforms and past the path defined by the foot support platforms such that the rider's weight or center of gravity is suspended out over the area behind the path of the foot support platforms. In this position the user is hanging from his hands and arms and pushing away from the foot support platforms with his feet. When the user operates the apparatus in this position he or she is pulling with the arms and pushing with the legs and feet in an attempt to maintain engagement with the machine. As the position of the apparatus is rotated from "0" degrees angle to an angle approximating "60" degrees the user changes his exercise activity from walking to hanging on and simulating climbing under then over a rock outcropping. This activity becomes very strenuous as the angle of rotation is increased towards "60" degrees or greater and is not sustainable for long periods of time when the user is engaging the full body exercise apparatus with only the hands and feet.

In another embodiment of the present invention the foot and hand levers do not need to be interconnected with each other. The foot platforms will be interconnected with each other but independent of the hand levers. The hand levers may be interconnected with each other or independent of each other. In either embodiment the hand levers may be independent of the foot platforms.

The full body exercise apparatus may provide for a secondary means of support for the user to facilitate the use of the apparatus at angles other than "0" degrees. The apparatus may provide a support configured to engage the user's back or buttocks to provide additional support to the user to proportion the support of the user between the feet, the arms and the user's back or buttocks. This secondary means of support permits the user to continue exercising at angles of rotation that the user's arms and feet could not maintain for long periods without the additional support of the secondary support. The secondary support permits the user to release the hand levers and engage only the foot support platforms and operate the apparatus with only the legs. In this position the user receives a strenuous leg and abdominal work out. The secondary support also permits the user to push with his arms instead of pulling with his arms by bracing the lower back or buttocks against the secondary support. This enables the user to exercise his triceps and pectoral muscles while always engaging the leg muscles. The apparatus also engages the Lats and Traps of the operator.

The simulated climbing and full body exercise may be conducted in a class setting. Spinning classes where the participants ride stationary bikes under the guidance of a class instructor are very popular. Recently, spinning classes for the upper body have been added to the programs available in some health clubs. The present method and apparatus allow the participants to exercise both their upper bodies and their lower bodies at the same time in the same class. The present apparatus would be a complete cardio, full body exercise in a class situation when used with the secondary support. The apparatus under the direction of the class instructor could be varied through angles from "0" degrees to not more than a maximum of "90" degrees while the participants simulate climbing steep surfaces under and then over outcrops. Depending upon the condition of the participants, the angle and the resistance settings a class may last for forty five minutes or longer. In spinning classes the participants can only increase the resistance against the flywheel or the cadence; with the present invention the participants may also increase the angle of the machine to increase the difficulty and challenge of the class as well as resistance and cadence. This great variability of range of angular adjustment, flywheel resistance and cadence would be an improvement over spinning classes because it includes more muscle groups for a more complete full body workout. The present apparatus and method may be connected to a computer with a pre-determined program that would take the participants on an imaginary climb up well know mountains such as Mt. Everest or easier mountains like Oregon's Mt. Hood. A visual device may be connected to the present invention that would allow the operator to watch the mountain that he is climbing or the outcrop that he is scaling over. The secondary support may be set at a fixed distance from the machine in one embodiment of the present simulated climbing apparatus or the distance may be permitted to be increased or decreased by shortening or lengthening the connecting rope, cable or linkage device to permit the operator to have slightly more or less support during the operation of the exercise apparatus. This shortening or lengthening of the connecting device may be manually done by the operator or may be pre-programmed into the apparatus and synchronized with the climbing program.

The operator may also pedal backwards simulating climbing down the side of a mountain. This may feel the most natural when the operator is using the secondary support device and the operator will feel as though he is on belay.

These and other advantages of the present invention will become apparent to those skilled in the art from the following detailed description of the invention and the accompanying drawings.

DESCRIPTION OF THE DRAWINGS

The present invention is illustrated by way of example, and not by way of limitation, in the figures of the accompanying drawings in which.

DETAILED OPERATION OF THE INVENTION

Figure 1:
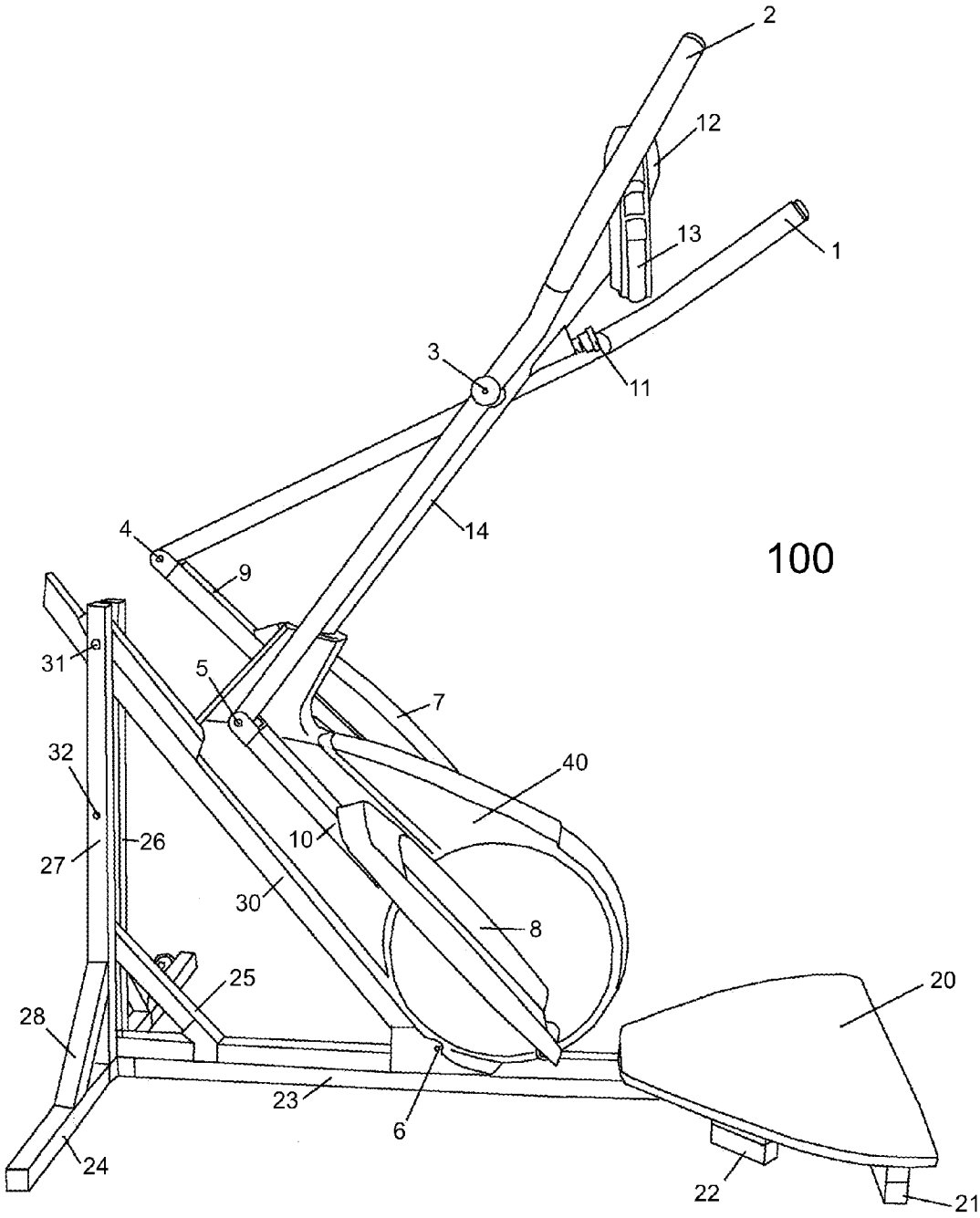
FIG. 1 is a side view of one embodiment of the present design.
Figure 2:
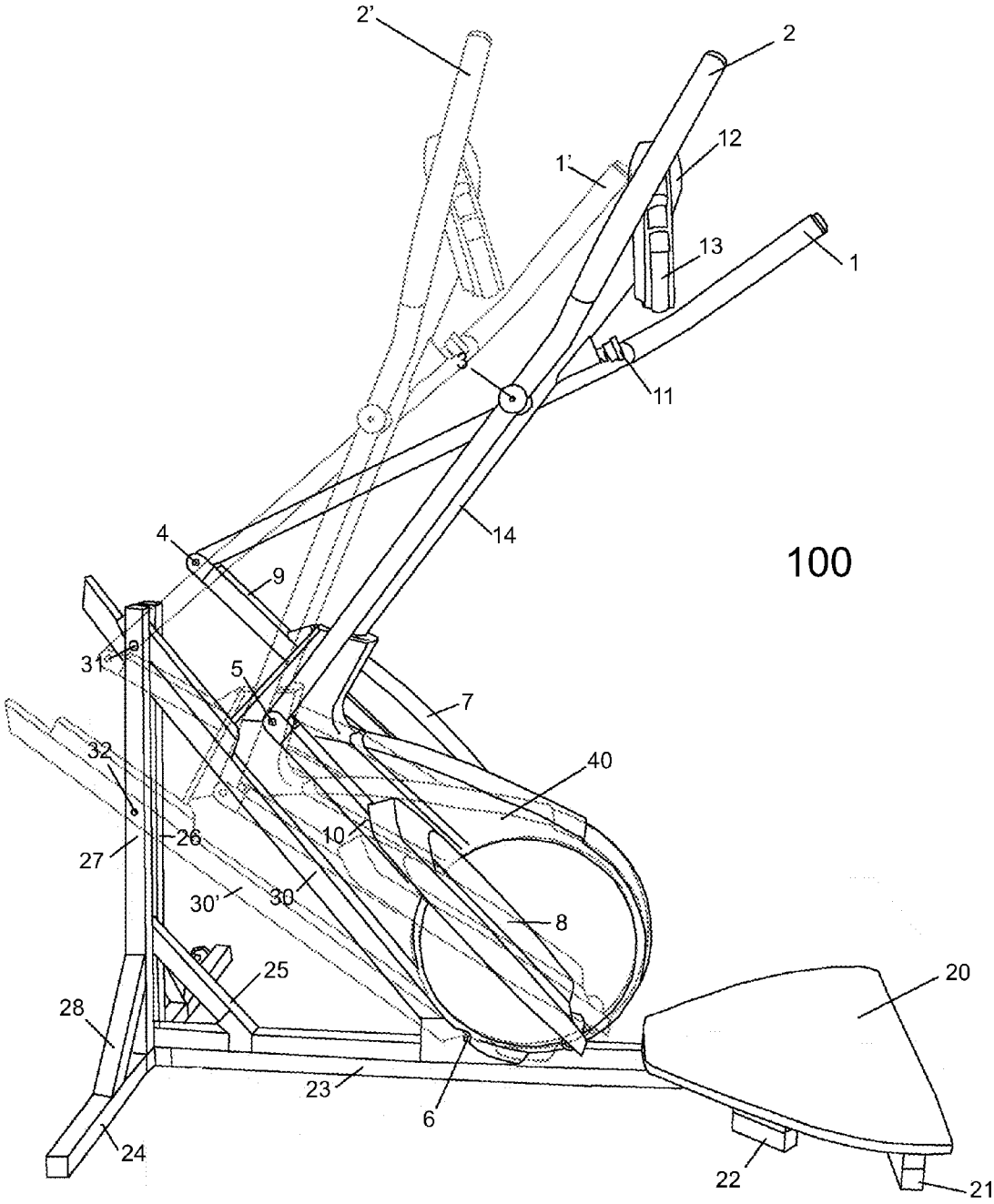
FIG. 2 is a side view illustrating apparatus in approximately "30" degree position in phantom lines and approximately the "50" position in solid lines in accordance with one embodiment of the present design.
Figure 8:
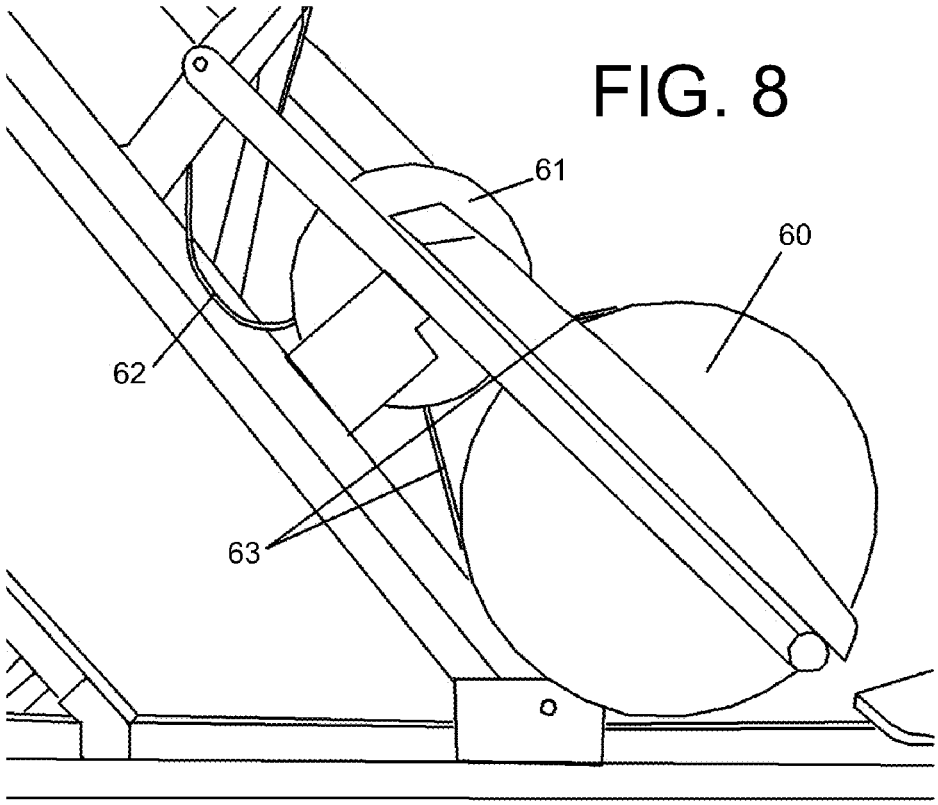
FIG. 8 is side view of the apparatus showing the flywheel, flywheel tension control cable, belt and belt drive sheave in accordance with one embodiment of the present design.

The present design is a full body exercise apparatus as shown in FIG. 1, 100, typically comprising a foot support platform 7 and 8 for each foot and a hand lever 1 and 2 for each hand associated with a framework 23 typically positioned on a smooth surface, e.g. hardwood, concrete or carpet floor, the exercise apparatus is able to be rotated rearward along with the user about pivot point 6 from an approximately vertical position to an angle of a maximum of "90" degrees. The apparatus may typically include a flywheel 61 in FIG. 8 and typically within shroud 40 FIG. 1 or some type of inertial device and some type of mechanical, frictional or magnetic resistance associated with the inertial device to resist the movement of the foot support platforms and the hand levers. Inertial devices and friction devices are well known to one schooled in the art of fitness equipment. The apparatus may include a step up platform 20 for the operator to prepare to step onto the foot support platforms. The foot support platforms and hand levers are configured to permit the operator to engage in a combination simulated running and climbing motion, FIG. 5; depending on the angle of the apparatus the operator is either climbing, running or fast walking with feet moving through a motion and hands accompanying the motion of the feet in a synchronized motion while the operator is suspended from the hand levers by his arms and hands and his feet are pressing against the foot support platforms. The apparatus may be inclined by rotating about the base of the apparatus at pivot point 6 through a range of degrees to simulate climbing out, around and over a rock ledge. The user may engage the hand grips and feet support platforms as a free climber would engage a rock wall or the user may be supported by the secondary support FIG. 4 and FIG. 6, similar to a climber on belay. The secondary device FIG. 4 supports the user's lower back or buttocks providing relief to the user's arms. The effort is greatly increased with frame angles greater than "30" degrees without the secondary support platform against the user's back or buttocks although this increased effort may be desirable to the advanced or highly conditioned athlete.

Figure 11:
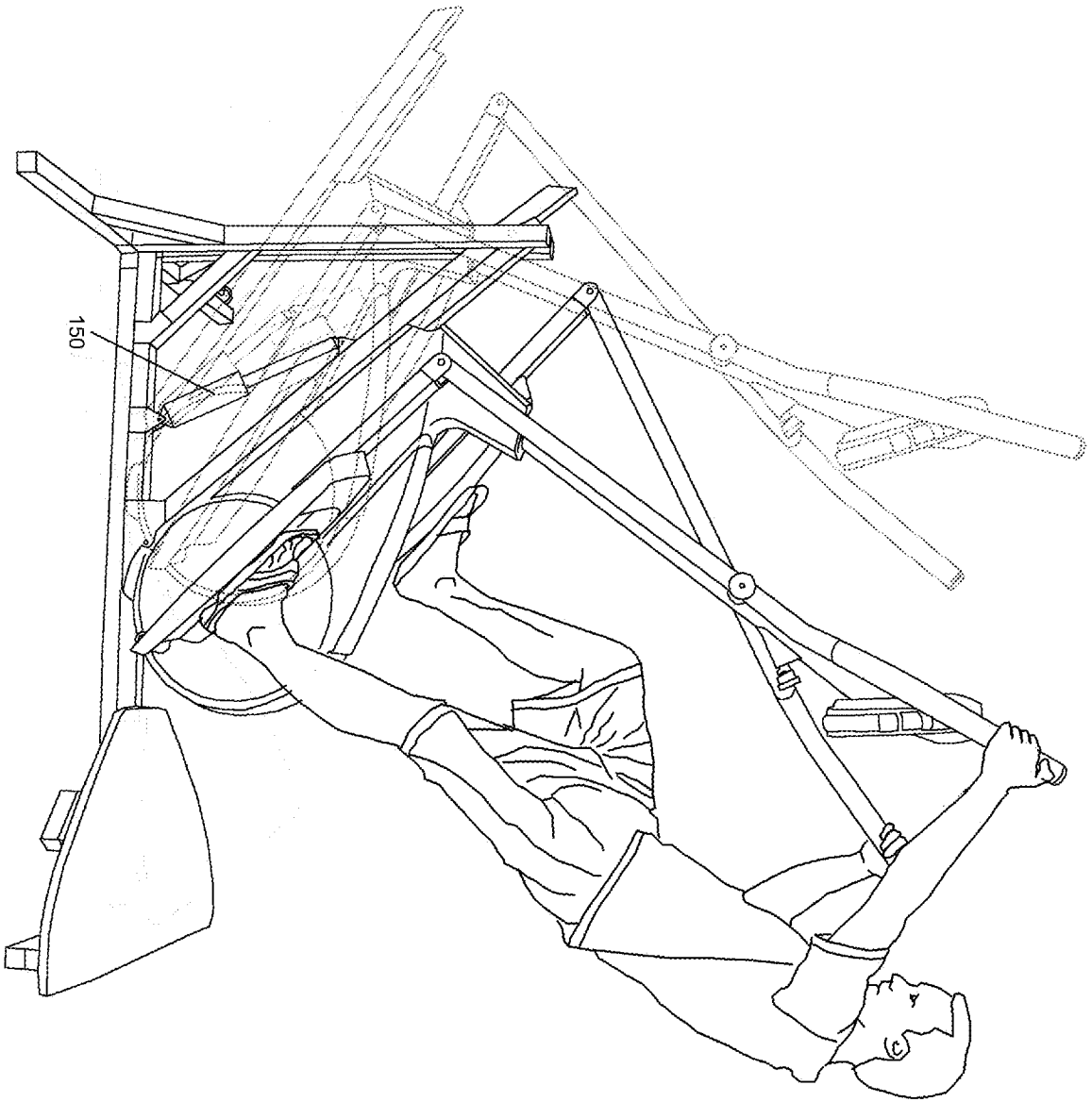
FIG. 11 is a side view of one embodiment of the apparatus showing the operator in two different positions and a hydraulic cylinder for the purpose of rotating the apparatus through various angles. The operator is shown in dark lines with the machine in approximately the "50" degree position. The machine without operator is shown in the approximate "20" degree position with the hydraulic cylinder stroke diminished to allow the machine to rotate forward about the lower pivot point.

The user may choose the resistance desired by adjusting friction control knob 11, FIG. 1, determine the difficulty desired by choosing a rearward angle between approximately "0" degrees and a maximum of "90" degrees and depending on the desired difficulty place the secondary support device behind the lower back or against the buttocks, place his feet on the foot support platforms, grasp the hand levers and begin moving the feet and hands in a running or fast walking cadence by rotating the foot support platforms about their crank arms and pushing and pulling against the hand levers respectively to begin exercising. At angles less than "30" degrees the user may decide not to use the secondary support but rather hang from the hand levers and press the feet against the foot support platforms while exercising. While exercising, the user continues the motion described above while the apparatus remains at a constant angle or while the machine is adjusted through a variation of angles to simulate changes in the steepness of the simulated climb. The adjustment of the apparatus may be actuated by hydraulic cylinder 150 FIG. 11. At angles beyond "50" degrees the effort required to maintain exercising is extreme and not sustainable without the assistance of the secondary support except by highly conditioned athletes. Depending on the inclined angle of the apparatus, more effort is exerted by the arms and hands or more effort is exerted by the legs and feet. The greater the angle the more effort is expended by the arms. Without the secondary support and at an angle of greater than "30" degrees the user's arms are exerted to extremes. When using the secondary support and at angles greater than "30" degrees, the rider may use his legs to perform the major effort and the abdominal workout comes into play. In this configuration the operator may bring in the triceps and pectoral muscles by using a pushing motion of the arms while the lower is back is supported by the secondary support. This will apply additional forces through the abdomen to increase the abdominal workout. The apparatus may be used with secondary support and the legs only.

The extreme position for exercise when using the apparatus is when the apparatus is angled at "50" degrees or more and the secondary support is not used. In this position the user may only continue the exercise for a limited time depending on the user's physical ability. A user in good physical condition may only be able to continue the exercise for under five minutes in this extreme setting without the secondary support. At this angle, with the secondary support, a user in superb physical condition may be able to continue to exercise for an indefinite period of time.

At "50" degrees or greater the user exercises the arms and abdominal muscles to a greater extent than a standard elliptical machine. The user will often change the location of the hands and feet while exercising. For the greater part of the exercise the user may put the hands at the tips of the hand levers and the feet all the way forward on the foot support platforms. For momentary periods the user may move the hands down low on the hand levers or remove the hands entirely from the hand levers to relax the arm muscles momentarily. This can only be done when using the secondary support and at this time the user continues pedaling with his legs. The user may at any time change the resistance applied to the flywheel to change the effort required. The user may also very the cadence to change the effort required. The apparatus may be operated with or without a flywheel or resistance device. The use of a flywheel or resistance device may enhance the experience.

The user may also very the distance from the torso to the apparatus. This may be accomplished by lengthening or shortening the length of the rope 51, FIG. 4, thus changing the distance of the secondary support from the apparatus to the user's back or buttocks. This variance also determines the amount effort required by the user's abdominal, arm and leg muscles. Depending on the angle the longer the distance from the secondary support and the apparatus the more effort must be exerted by the user's arms and abdominal muscles.

The relative effort exerted by the arms and the relative path of travel of the arms relative to effort exerted by the legs and the relative path of travel of the legs may be varied by changing the location of the pivot points 3, FIG. 1, of the arms and the relative length of the lever arms and their relative location to their attachment point 4 to the foot support platforms. The stride of the foot support platforms may be varied by varying the length of the crank arms 17 and 18 FIG. 3 between where the foot platforms attach at one end of the crank arm and the axis 19 that determines the center of the crank arm's rotation at the other end of the crank arm. This distance may be the length of the crank arm of a bicycle or may be varied to provide the best relationship between hand and foot movement and length of stride of the user. This distance is normally fixed but may be adjustable to accommodate different size riders.

In another embodiment of the apparatus, the foot platforms may be separate from the hand levers. In another embodiment of the apparatus the foot platforms may vary the stride length, the height and the shape of the path the foot platforms travel by the use of rollers and linkages. In another embodiment of the apparatus the hand levers may engage hydraulic cylinders or other dampening means to resist the movement of the hand levers. In another embodiment of the apparatus the hand levers may engage a flywheel separate from the flywheel engaged by the foot platforms enabling the operator to have different resistances engaged by the operator's feet and the operator's hands. In another embodiment of the apparatus the foot platforms may be a replaced by a treadmill. In this embodiment the operator would use the secondary support around the lower back or buttocks.

DETAILED DESCRIPTION OF THE INVENTION

Figure 3:
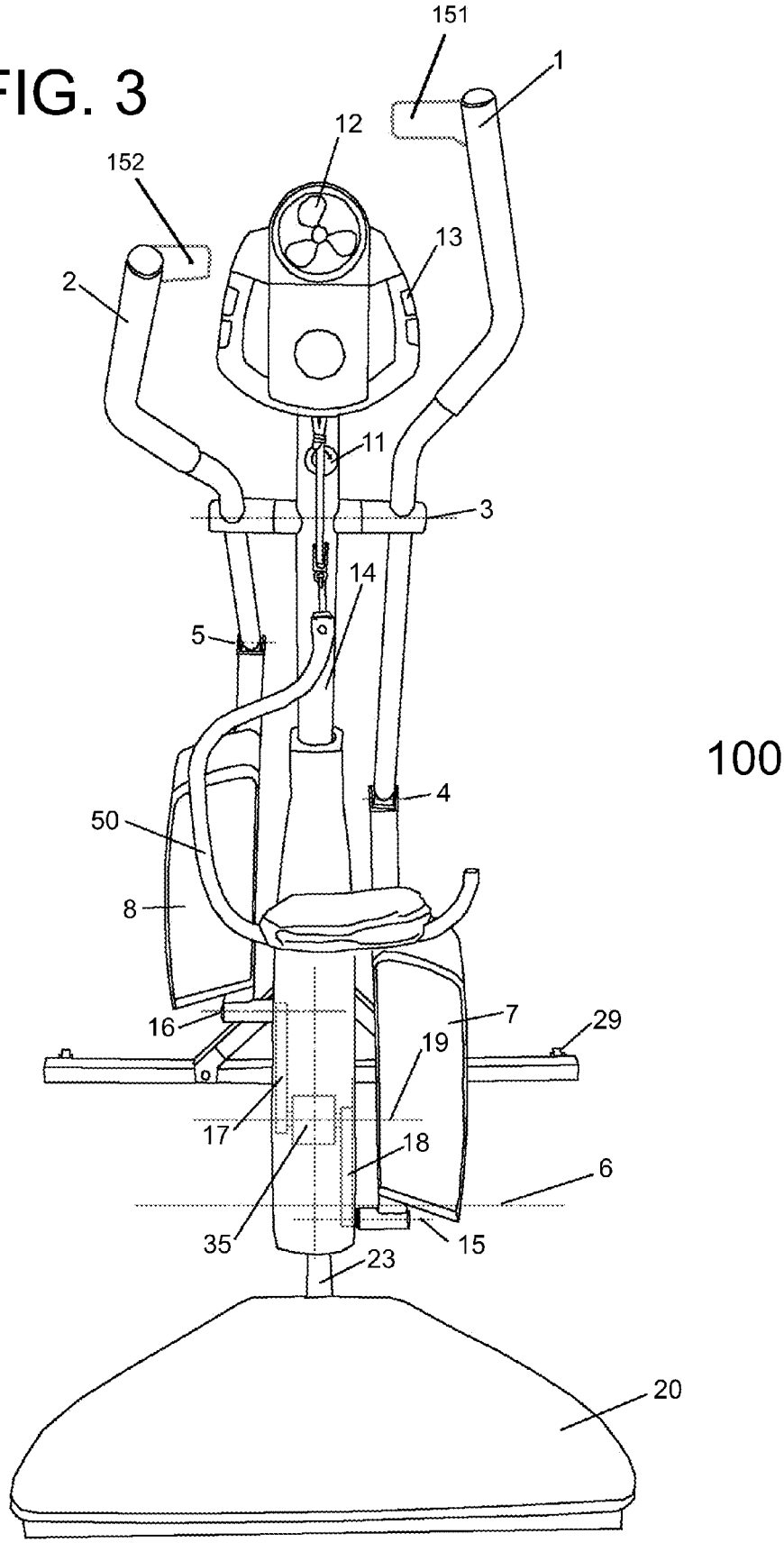
FIG. 3 is front on view illustrating the apparatus with the secondary support attached in accordance with one embodiment of the present design.

The simulated climbing and full body exercise device may be made from steel, plastic, wood, aluminum or other favorable construction material. In this preferred embodiment and as shown in FIG. 1, square tube 24 may be connected to square tubes 23, 21, 22 to form a base. Wheels 29 FIG. 3 may be connected to tube 24 to facilitate movement of apparatus 100. Platform 20 may be made from wood, metal or plastic and is the entry platform for the user to prepare to mount the foot support platforms 7 and 8. Vertical tube 26 and 27 may be fixedly attached to base tube 24 and maybe braced by tubes 28 and 25 and a tube opposite 28. Main support tube 30 may be pivotally attached to base tube 23 at pivot point 6 and maybe fixedly attached to vertical support tube 27 at locations 32 and 31. When main support tube 30 is fixedly attached at location 32 the angle of operation of the apparatus is approximately "30" degrees' when main support tube 30 is fixedly attached at location 31 the angle of operation of the apparatus is approximately "50" degrees'. It will be appreciated that main support tube 30 maybe fixedly attached at points 31 and 32 or maybe varied at any incremental angle between approximately "0" degrees and "90" degrees by means of rack and pinion adjustment, hydraulic cylinder adjustment 150 FIG. 11, manually or any other means of varying and or securing the angle of main support tube 30 about pivot point 6. The apparatus is shown fixedly secured at point 31 for the purpose of demonstration not for the purpose of limitation. Fairing 40 encloses crank arms 17 and 18, cross shaft 35 and pedal shafts 16 and 15 as shown in FIG. 3. Foot support platform 19 is rotatably connected to pedal shaft 15. Pedal shaft 15 is rotatably connected to crank arm 18. Crank arm 18 is fixedly connected to shaft assembly 35. Foot support platform 8 is rotatably connected to pedal shaft 16. Pedal shaft 16 is rotatably connected to crank arm 17. Crank arm 17 is fixedly connected to cross shaft 35. Movement of foot support platform 19 imparts rotation to crank arm 18 and through cross shaft assembly 35 rotation of crank arm 17 and movement of foot support platform 8.

Figure 7:
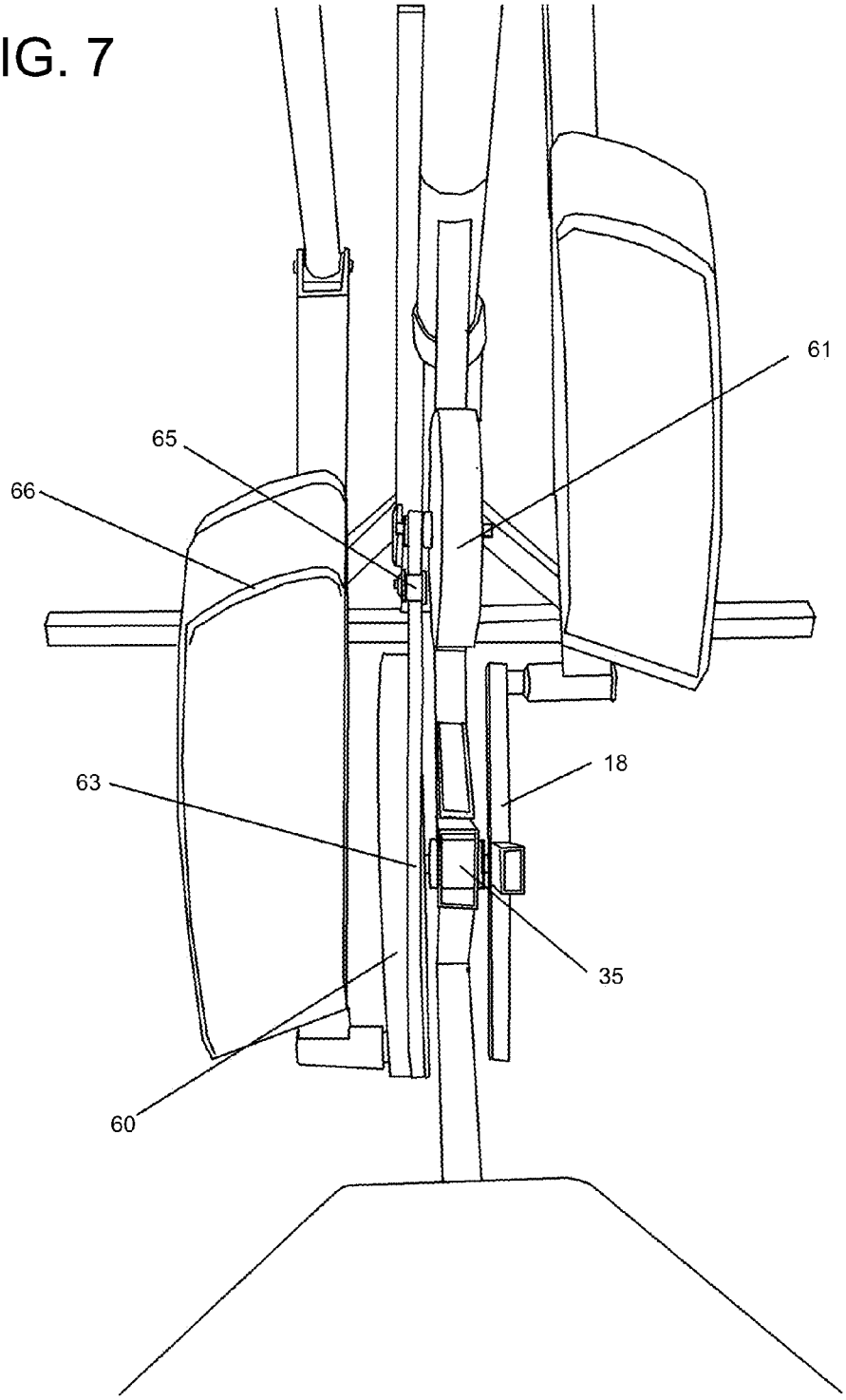
FIG. 7 is a front on view of the apparatus showing the crank arms, belt drive, belt tensioner and flywheel in accordance with one embodiment of the present design.

In FIG. 7 sheave 60 is attached to crank arm 17 and operatively engaged with belt 63 and belt tensioner 65 and may induce rotation of flywheel assembly 61. Flywheel 61 maybe resisted by friction or magnetic device and the rotational resistance may be varied by friction adjustment knob 11 FIG. 3 by means of friction adjustment cable and housing 62 FIG. 8.

Figure 10:
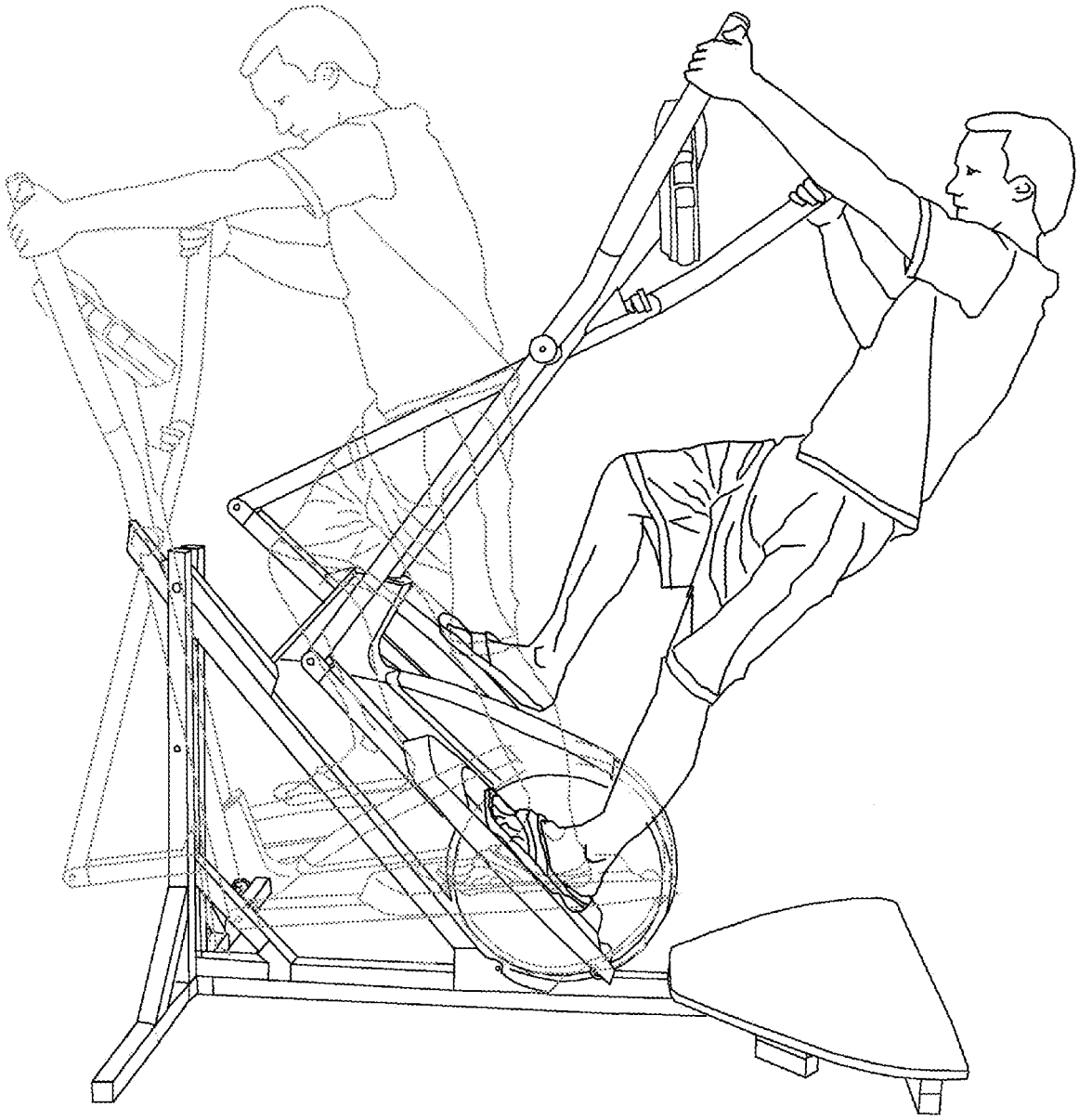
FIG. 10 is a side view of the apparatus showing machine and operator in two different positions. The rider and machine are shown in dark line detail in the "50" degree position and in light line detail in the "0" degree or vertical position. The rider and machine may be positioned in any relative position to vertical between "0" degrees and a maximum of "90" degrees in accordance with one embodiment of the present design.

In FIG. 10 it will be appreciated that the operator may be in the vertical position similar to many common exercise machines and engage both hands and feet with hand levers and foot platforms as shown in the lightly drawn figure or in this embodiment of the apparatus the apparatus may be rotated about rotation point 6 FIG. 1 enabling the operator's weight to be suspended by the operator's arms and supported by the operator's feet as shown in the darkly drawn figure in FIG. 10. In this embodiment of the apparatus the operator is suspended by arms and supported by feet without additional support of the operator's body by means of secondary support.

In FIG. 1 foot platform 8 may rest on foot platform support arm 10. Support arm 10 may be pivotally connected to rotation point 5. Rotation point 5 may be pivotally connected to distal end of hand lever 2. Hand levers 1 and 2 may be pivotally connected to rotation point 3 on main frame support tube 14. Hand levers 1 and 2 and foot platforms 7 and 8 maybe operationally engaged through pivot points 3, 4 and 5 and crank arms 17 and 18, through shaft 35 and foot platform shafts 15 and 16 providing the operator with the ability to engage foot platforms and hand levers in a simulated climbing and full body exercise. Motion of foot platforms and hand levers are operatively engaged providing the operator to move the foot platforms with his feet while simultaneously pulling and or pushing on the hand levers. This action may be carried out against mild resistance, no resistance or great resistance through the engagement of the sheave 60 and flywheel 61 and frictional or magnetic resistance. The apparatus 100 including the foot platforms and hand levers may also be rotated from vertical or "0" degrees to any angle of maximum "90" degrees by rotating the apparatus 100 about rotation point 6 FIG. 1.

Foot platforms 7 and 8 FIG. 1 may be longer in length than a typical adult male's foot. The foot platforms may be long enough to allow the operator to move his feet from the front of the foot platform to the rear of the platform. The foot platforms may include a stop or bumper at the front of the platform for the operator to stop the toe of his shoe against. The foot platform may be open at the rear to allow the operator to move the ball of his foot substantially toward the rear of the foot platform.

Hand levers 1 and 2 FIG. 1 may be long enough to permit the operator to choose several locations for the hand to engage the hand lever. The hand levers may be coated along part of their length with a softer gripping material. The hand levers may be curved inward to provide a horizontal surface for the operator's hands 151 and 152 FIG. 3. The operator may put his hands at the top of the hand levers as shown in FIG. 10 or he may put is hands lower down on the hand levers. The operator may place his hands lower on the hand levers and places his feet against the stops on the front of the foot platforms or he may put his hands higher on the hand levers and his feet toward the rear of the foot platform. Either position is equally effective for the purpose of simulating a climbing exercise.

Figure 12:
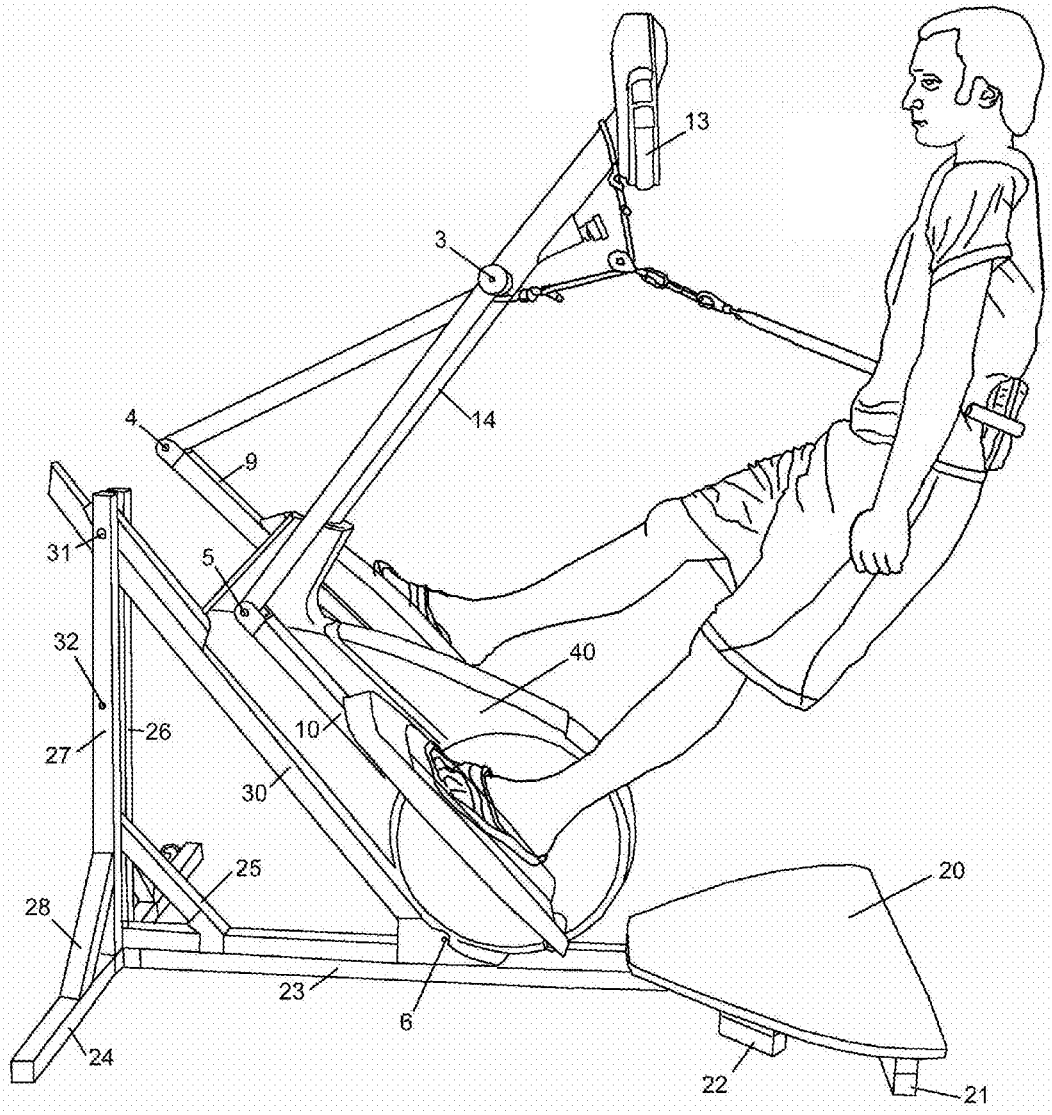
FIG. 12 is a side view of one embodiment of the apparatus without hand levers showing the operator with harness using the machine only with the legs in the approximate "50" position.

The operator may rotate resistance knob 11 FIG. 1 to increase or decrease the resistance of the flywheel. The flywheel 61 is operatively engaged with sheave 60 through belt 63. Sheave 60 is operatively engaged with foot platforms 7 and 8 and hand levers 1 and 2 to enable the operator to increase or decrease the exercise effort by increasing or decreasing the resistance of flywheel 61 to rotation. The flywheel may be engaged by the foot platforms independently of the hand levers in one preferred embodiment of the apparatus as shown in FIG. 12. In the embodiment as shown in FIG. we there are no hand levers only foot platforms.

Figure 6:
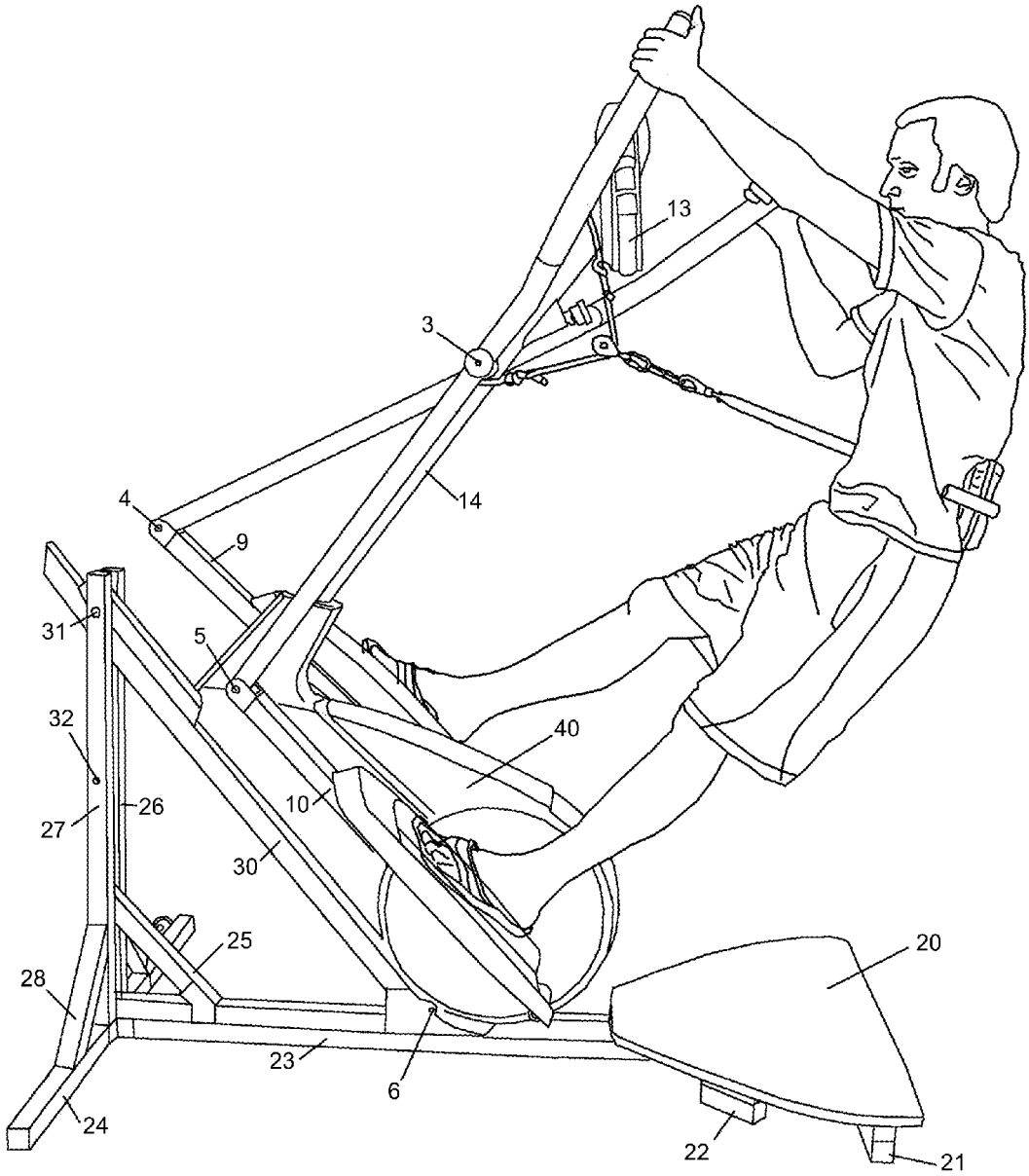
FIG. 6 is a side view of the apparatus showing the machine and operator in approximately the "50" degree position with the rider engaging the hand levers and with feet on the platform and with secondary support accordance with one embodiment of the present design.

The simulated climbing apparatus may include a visual screen 13 FIG. 6 displaying any number of readouts to include distance traveled, work done, altitude climbed or a display of a mountain being climbed and the climbing effort synchronized with the movement of the apparatus. Steep elements of the climb would accompany greater angles or rotation of the machine toward the rear increasing the amount the operator is suspended by his arms and increasing the amount of pressure applied to the feet.

The simulated climbing apparatus may include a pulse rate monitor FIG. 6 and a cooling fan 12.

Figure 4:
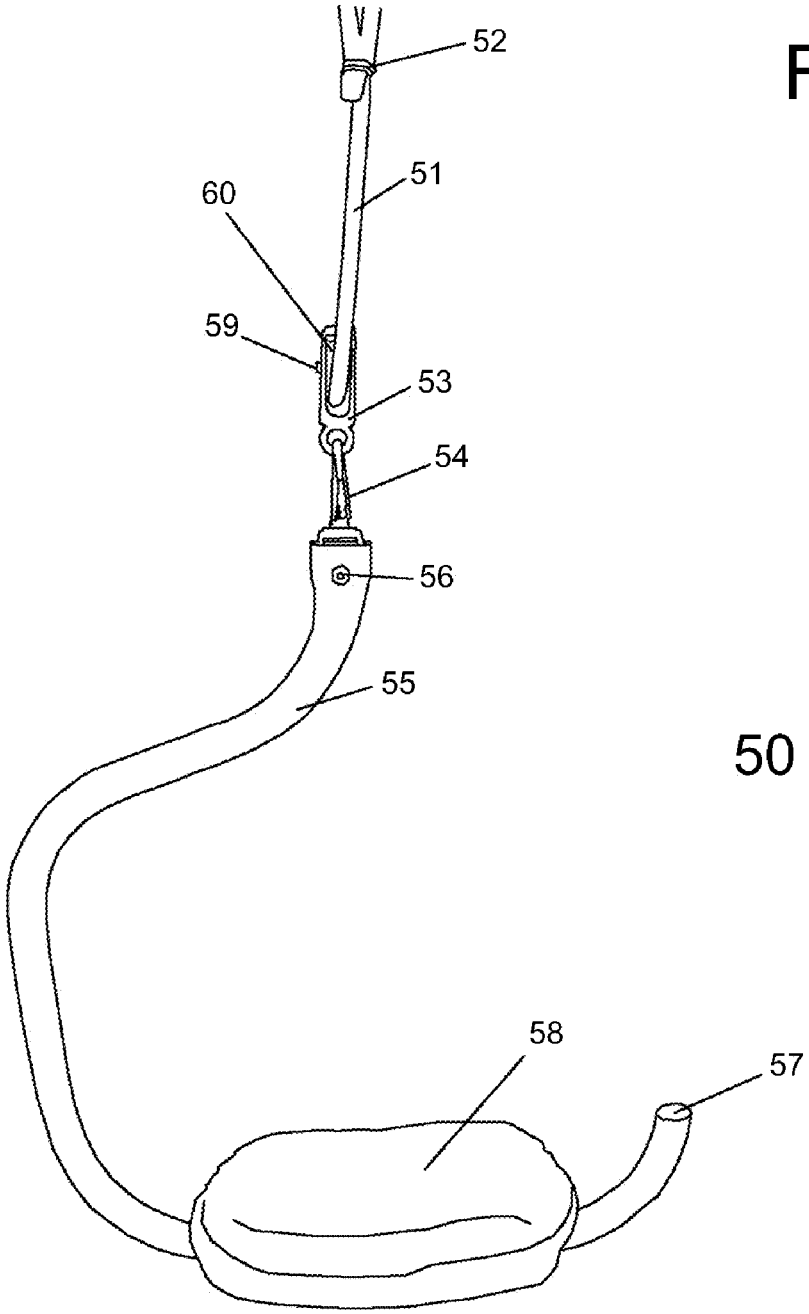
FIG. 4 is a close up view of the secondary support in accordance with one embodiment of the present design.
Figure 5:
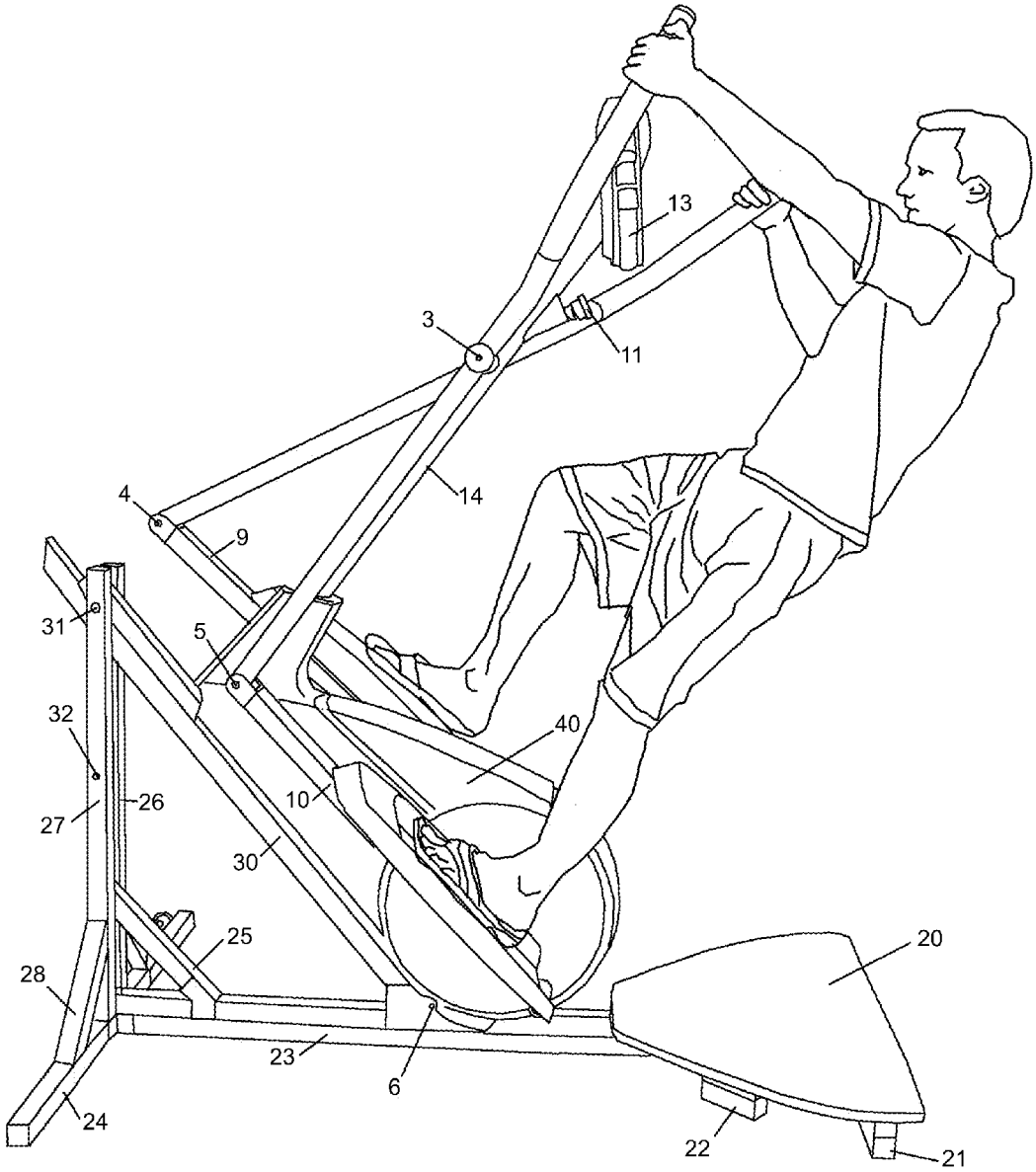
FIG. 5 is a side view of the apparatus showing the machine and operator in approximately the "50" degree position with the rider engaging the hand levers and with feet on the platform and without secondary support in accordance of one embodiment of the present design.

In FIG. 4 in one embodiment of the apparatus a secondary support for the operator's body may be engaged by the rider to further enhance the simulated climbing experience. Structure 55 may be constructed of a metal tube curved to wrap around the operator's body. Pad 58 may be attached to structure 55 and may engage the operator's body generally at the buttocks or lower back. Structure 55 may be shaped to allow the operator to easily slip the structure about the body and rest it against the back or buttocks. Hook 54 may be attached to structure 55 and may operatively and releasably connect to sheave block 53. Within sheave block 53 sheave 60 is rotationally secured by pin 59. Rope 51 passes through sheave block and sheave assembly 53, 59 and 60 permitting the assembly to move up and down rope 51. Support structure may also move laterally from side to side about rope 51 permitting the operator to swing from side to side when operating the simulated climbing exercise apparatus. Rope 51 is secured by clamping wire cinch 52 after encircling main support post 14 FIG. 6. The secondary support may also be constructed of metal tubing (not shown) with rollers attached to act in the same manner as a pulley and rope such that it does not hang down freely when not in use but may be released from the operator and moved to the side out of the way of the operator.

The design presented herein and the specific aspects illustrated are meant not to be limiting, but may include alternate components while still incorporating the teachings and benefits of the invention, namely simulated climbing apparatus and full body exercise apparatus and method enabling the operator to position his center of gravity away from the vertical axis in a manner that permits the operator to hang from his hands and press with his feet to participate in a climbing exercise simulation. While the invention has thus been described in connection with specific embodiments thereof, it will be understood that the invention is capable of further modifications. This application is intended to cover any variations, uses or adaptations of the invention following, in general, the principles of the invention, and including such departures from the present disclosure as come within known and customary practice within the art to which the invention pertains.

What is claimed is:

1. An apparatus permitting a user to perform a simulated climbing and full body exercise, comprising:

a frame having a base frame and a front upright;

a frame pivot mechanism comprising a framebar having a rear end pivotally connected to the base frame at a pivot point and having a front end having means for height adjustable connection to said front upright;

a lever arm positioned in association with said frame configured to be engaged by the rider's left hand;

a foot platform positioned in association with said frame configured to be engaged by the rider's left foot;

a lever arm positioned in association with said frame configured to be engaged by the rider's right hand;

a foot platform positioned in association with said frame configured to be engaged by the rider's right foot;

each said lever arm configured to engage said foot platform such that movement of said lever arm initiates movement of said foot platform and;

each said left or right lever arm and each said left or right foot platform configured such that movement of each said left lever arm or left foot platform initiates movement of said right lever arm or said right foot platform and;

wherein said frame pivot mechanism;

said lever arms and;

said foot platforms are configured to rotate about said pivot point and; whereby said lever arms and said foot platforms can be moved through a variable angle to place the operator's body in a position angled away from said frame, said lever arms and said foot platforms permitting the operator to be supported by hanging from the hands and engaging the foot platforms by the feet.

2. A method for enabling a user to perform a simulated climbing and full body exercise, comprising:

providing a frame having a base frame and a front upright;

a frame pivot mechanism comprising a framebar having a rear end pivotally connected to the base frame at a pivot point and having a front end having means for height adjustable connection to said front upright;

employing a lever arm positioned in association with said frame configured to be engaged by the rider's left hand;

employing a foot platform positioned in association with said frame configured to be engaged by the rider's left foot;

employing a lever arm positioned in association with said frame configured to be engaged by the rider's right hand;

employing a foot platform positioned in association with said frame configured to be engaged by the rider's right foot;

each said lever arm configured to engage said foot platform such that movement of said lever arm initiates movement of said foot platform;

each said left or said right lever arm and each said left or said right foot platform configured such that movement of each said left lever arm or said left foot platform initiates movement of said right lever arm or said right foot platform;

wherein said frame pivot mechanism;

said lever arms and;

said foot platforms are configured to rotate about said pivot point and whereby;

said lever arms and said foot platforms can be moved through a variable angle to place the operator's body in a position angled away from said frame, said lever arms and said foot platforms enabling the operator to hang from the hands and engage said foot platforms by the feet;

enabling the operator to perform a simulated climbing activity and;

enabling the operator to perform a full body exercise.

3. A method as in claim 2 for enabling a user to perform a simulated climbing exercise with the legs, comprising:

employing a support configured to engage the operator's body;

wherein said frame;

said foot platforms and;

said support configured to place the operator's body in a position angled away from the frame permitting the operator's feet to be engaged by said foot platforms and operator's body to be engaged by said support;

enabling the operator to engage said foot platforms with the feet and engage said support with the body;

enabling the operator to perform a simulated climbing exercise.

4. An apparatus as in claim 1 permitting a user to perform a simulated climbing and full body exercise, including:

a support configured to engage the operator's body;

wherein said frame;

said lever arms and;

said foot platforms are configured to rotate about said pivot mechanism and whereby;

placing the operator's body in a position angled away from said frame, said lever arms and said foot platforms permitting the operator to be supported by hanging from the hands and engaging the foot platforms by the feet and supported by the engagement of said support with the operator's body.

* * * * *